United States Patent [19]

Clare et al.

[11] Patent Number: 4,519,803

[45] Date of Patent: May 28, 1985

[54] PRINTING ON PRETREATED SUBSTRATES

[75] Inventors: Kenneth Clare, San Diego, Calif.; Erle Hopkinson, Horely, England

[73] Assignee: KELCO/AIL International Limited, London, England

[21] Appl. No.: 499,934

[22] Filed: Jun. 1, 1983

[51] Int. Cl.[3] ..... D06P 5/00

[52] U.S. Cl. ..... 8/445; 8/506; 8/557; 8/561; 8/594; 8/602; 8/625; 8/635; 8/922

[58] Field of Search ..... 8/445, 557, 625, 635, 8/506, 561, 554, 582, 594, 602

[56] References Cited

U.S. PATENT DOCUMENTS 4,222,740 9/1980 Bohrn et al. ..... 8/448
4,264,322 4/1981 Lewis et al. ..... 8/479

FOREIGN PATENT DOCUMENTS 1587930 4/1981 United Kingdom .

*Primary Examiner*—A. Lionel Clingman
*Attorney, Agent, or Firm*—Gabriel Lopez; Hesna J. Pfeiffer

[57] ABSTRACT

In the printing of dyes onto substrates, the pretreatment of the substrates with low levels of calcium or sodium salts or other gelling/insolubilizing agents effectively reduces dye usage.

11 Claims, No Drawings

PRINTING ON PRETREATED SUBSTRATES

The use of alginates in textile print pastes is well known. For example, GB 021,609 teaches a thickener containing sechydroxyalkyl alginate or an amine salt of alginic acid, or sechydroxyalkyl alginate mixed with derivatives of polymers of acrylic acid or maleic anhydride/ethylene copolymers.

It is also well known that alginates react with bivalent metal cations, most notably calcium, to form gels. The combination of algins and calcium salts has been disclosed in U.S. Pat. No. 4,222,740 as a means of forming dye resist areas on textiles. As taught therein, gelled regions are formed by separately applying a gelable (alginate) composition and a gelling (calcium) agent composition to a textile and then over-dyeing the material, the gelled regions serving as dye resist areas. In another embodment, lateral ink spread is taught to be reduced by incorporating a dye into either the gellable composition, the gelling compositions, or both. The amount of gelling agent taught must be sufficient to gel the alginate composition. Specifically, a 5% (by weight) composition is recommended, although 1–10% is taught to work. The amount of alginate is taught to be from 0.5 to 5% by weight, preferably 1% to 2.5%.

It has now been found that when very low levels of gelling agent are used to pretreat a substrate, the dye usage for equal colour yield is reduced, accompanied by improved print definition.

By alginate is meant the water-soluble derivatives and salts of alginic acid which form gels in contact with bi- or ter-valent metal cations such as calcium. Alginates are found in all species or Phaeophyceae, brown algae. A variety of alginates may be used in the practice of this invention. Where a high-viscosity alginate is used, the amount of gelling agent is reduced. Likewise, if a low-viscosity alginate is used, the amount of gelling agent must be increased. The amount and type of alginate used in any particular application will, of course, be dependent on the other materials in the print paste, e.g., oxidizing agents, buffers, etc. These can be determined by the individual practitioner depending on his particular formulation. However, usage levels in the range 0.2 to 6.0% by weight are within the scope of this invention; preferably 0.3 to 2.5%. Optionally, thickening agents such as guar, locust bean gum, CMC, suitable synthetic polymers, and starch ether may be included to provide viscosity.

The gelling composition comprises water and a soluble bivalent or tervalent metal salt, preferably a calcium salt such as the chloride. The amount of metal cations used is very low, comparable to the amount obtained by preparing a 0.025 to 0.75% by weight (anhydrous) calcium chloride solution. When applied to fabrics of differing pick-up capacity, this will amount to between 0.03–0.5% calcium (as $CaCl_2$ anhyd.) based on the weight of the fabric. Aluminium and chromium salts, for example, could also be used.

in another embodiment of this invention, the substrate pre-treatment is accomplished not with the use of a bivalent or tervalent metal gelling agent but with the salt of a univalent metal ion, such as sodium chloride, or an organic acid such as citric acid (0.35 to 1.0%). An aqueous solution is used comprising 5 to 20% by weight (preferably, 10%) of the chloride, nitrate, or sulphate salts of sodium, potassium, or lithium.

Likewise, alternative thickener/gelling systems, based for example on cellulose derivatives such as sodiumcarboxymethyl cellulose, galactomannans, such as carboxymethyl guar and de-polymerised guar, and starch derivatives, may be used. In such cases appropriate gelling agents are aluminium chloride and di-sodium tetraborate. The use of these alternative gelling systems provides benefits similar to the alginate system in terms of improved definition and reduced print paste consumption, but alginate gives a technically superior result and is preferred.

In another embodiment of this invention, instead of using a salt, the substrate is pre-treated with 0.1 to 1.0% of a cationic gelling agent. These cationic gelling agents include polyhexamethylene biguanide hydrochloride.

The print pastes of this invention are those prepared using disperse dyes, reactive dyes, combinations of disperse and reactive dyes, and acid dyes, i.e., all anionic or non-ionic dyes but not cationic dyes. Pigment printing systems may also be included. The invention is most effective with disperse dyes. In addition to the alginate and dye, these print pastes comprise a variety of well known compounds such as buffers, oxidizing agents, etc. The preparation of such pastes is known in the art. In the practice of this invention, the amount of free bivalent or tervalent metal cations in the print paste composition should be kept low. Therefor if hard water is used to prepare such compositions the use of a sequestrant is recommended but at levels low enough not to interfere with the gelling reaction.

The substrates to be treated include, for example, polyesters, cellulosics, blends of these, and polyamides. The substrates can be any material which can be printed with the appropriate dyes.

In the process of this invention the substrate is first treated with the gelling agent composition of univalent salt composition. Typical application techniques are padding, immersing, foaming and spraying. The substrate is preferably then dried prior to application of the print paste although in some applications either partial or no drying is also acceptable. Drying is preferred especially where good definition or colour yield is required. The treated substrate may be dyed immediately or stored for later use. The print paste composition can be applied by any conventional printed or dye method such as flat or rotary screen printing, block or raised relief printing, jet printing, stencil printing, engraved cylinder printing, Tak dyeing, Kuster dyeing, dip squeeze application or hand application.

When a substrate is treated according to this invention, it is sometimes observed that less (about 20–50%) print paste is taken up by the substrate. The actual colour intensity achieved will depend upon the print paste pick-up and the control of penetration into the substrate but the amount of dye actually consumed can be reduced by up to about 40%.

Following application of the print paste the substrate is treated as necessary to fix any dyes, then washed, dried and otherwise treated by conventional methods to produce the desired end produce.

The following examples, which are intended to be illustrative and not limiting, further describe the invention and also compare the present invention to that of U.S. Pat. No. 4,222,740. In these examples, evaluation of the results is done by visual observation of the final dried substrate. Percentages are by weight unless otherwise stated.

EXAMPLE 1

Resist Dye Process—One Dye

Following the teachings of U.S. Pat. No. 4,222,740, a piece of fabric is treated to produce areas resistant to dyeing and then the fabric is printed to determine the efficacy of the treatment.

Polyester knitted fabric is printed with a paste comprising:

| | Wt. % |
|---|---|
| Matexil PA-L (sodium-m-nitrobenzene sulphonate), oxidizing agent | 1.0 |
| Mon-sodium orthophosphate, buffer | 0.1 |
| Manutex M300 (medium viscosity sodium alginate) | 3.0 |
| Water (D.I.) | 95.9 |
| Total | 100.0 |

Manutex is a Trademark of Alginate Industries Ltd., London, U.K.

The printed fabric is then padded for 30 seconds in a solution containing 5.0% anhydrous calcium chloride. It is then given a cold-water rinse and dried.

The treated fabric is then over-printed with a print paste constituted as above but containing 5.0% Dispersol Blue R-PC (ICI Ltd. Blakeley, Manchester, U.K.). Fixation is then carried out by H.T. steam at 175° C. for 7 minutes. The fabric is then washed in a solution containing 1% Calgon PT (sodium hexa-m-phosphate) (Albright & Wilson Ltd., Oldbury, Worcestershire, U.K.) followed by a conventional soap and rinse.

After this treatment the part printed with the alginate solution is essentially uncoloured whereas the rest of the printed area is blue, thus demonstrating the dye-resist efficacy of this treatment.

However, when this procedure is repeated using 0.1% calcium chloride instead of 5.0%, the treated areas do not resist dyeing and in the finished product the blue dye is seen to cover both the gelled and non-gelled areas.

EXAMPLE 2

Resist Dye Process—Two Dyes

Following the procedure of Example 1 but using a dye in both the pretreatment and in the print paste, another piece of fabric is tested.

Polyester knitted fabric is printed with a paste comprising:

| | Wt. % |
|---|---|
| Dispersol Yellow C-4R Liquid | 5.0 |
| Matexil PA-L (sodium-m-nitrobenzene sulphonate) | 1.0 |
| Mono-sodium orthophosphate | 0.1 |
| Manutex M300 (medium viscosity sodium alginate) | 3.0 |
| Water | 90.0 |
| Total | 100.0 |

The printed fabric is then padded (with 70% expression or add-on) in a solution containing 5.0% anhydrous calcium chloride. It is then given a cold water rinse and dried.

The treated fabric is then over-printed with a print paste constituted as above but with Dispersol Blue R-PC substituted for the yellow dye. Fixation is then carried out by H.T. steam at 175° C. for 7 minutes. The fabic is then washed in a solution containing 1% Calgon PT (sodium hexa-m-phosphate) followed by a conventional soap and rinse.

After this treatment the part printed with alginate/yellow dye is coloured yellow, the remainder of the printed area is blue.

When this procedure is repeated using 0.1% calcium chloride instead of 5.0%, the treated areas do not resist dyeing and in the finished product the blue colour is seen only on the non-gelled areas but a green colour is seen in the gelled areas printed with alginate/yellow dye.

EXAMPLE 3

Low Calcium Level Pretreatment

To demonstrate the effectiveness of pretreating substrates with low levels of di- or trivalent metal cations, untreated and treated fabrics are printed as follows:

Polyester knitted fabric is padded (with 70% expression) in solutions containing 0.025, 0.05, 0.075, 0.125, 0.175, 0.225, 0.275, 0.325, 0.375, 0.425, 0.475, 0.5, 1.25 and 2.5% anhydrous calcium chloride.

After drying the treated fabrics were printed with a print paste comprising:

| | Wt. % | Control (for nontreated fabric) Wt. % |
|---|---|---|
| Dispersol Rubine C-B liquid (ICI) | 5.0 | 5.0 |
| Matexil PA-L, sodium-m-nitrobenzene sulphonate) (ICI) | 1.0 | 1.0 |
| Mono-sodium orthophosphate (Albright & Wilson) | 0.1 | 0.1 |
| Manutex RS, high viscosity sodium alginate | 1.5 | 2.2 |
| Calgon, sodium hexa-m-phosphate | 0.4 | 0.5 |
| Water (D.I.) | 92.0 | 91.2 |
| Total | 100.0 | 100.0 |

Use of anhydrous calcium chloride at levels up to 0.275% provides improved print definition and an increase in colour yield as indicated by a significant increase in the sharpness of fine line detail and a greater intensity of colour.

When the fabric is treated with solutions containing anhydrous calcium chloride at levels above 0.275% the fabric coverage becomes progressively poorer and the colour-yield is reduced. Use of anhydrous calcium chloride at 0.15% provides improved print increase in colour yield of 40% compared with the untreated control fabric. When the fabric is treated with gelling solutions in the range 1.0%–10.0%, fabric coverage is poor and the colour yield is reduced by more than 50%.

EXAMPLE 4

Pretreatment with Univalent Salt

Polyester knitted fabric is padded (with 70% expression or add-on) in a solution containing 10.0% sodium chloride. After drying, the treated fabric is printed with a print paste comprising:

| | Wt. % | (Conventional Recipe) Wt. % |
|---|---|---|
| Dispersol Rubine C-B liquid | 5.0 | 5.0 |
| Matexil PA-L, sodium-m-nitrobenzene sulphonate | 1.0 | 1.0 |
| Mono-sodium orthophosphate (Albright & Wilson) | 0.1 | 0.1 |

-continued

| | Wt. % | (Conventional Recipe) Wt. % |
|---|---|---|
| Manutex F, low viscosity | 4.5 | 6.0 |
| sodium alginate | 4.5 | 6.0 |
| Calgon, sodium hexa-m-phosphate | 1.1 | 1.5 |
| Water (D.I.) | 88.3 | 86.4 |
| Total | 100.0 | 100.0 |

The dye is then fixed on the printed material by H.T. steam at 175° C. followed by the normal wash procedure and the fabric is dryed. The fabric exhibits superior definitions and colour yield.

We claim:

1. A process for printing substrates which comprises:
(A) applying to at least a portion of a substrate a first aqueous composition comprising (1) 0.025 to 0.275 wt. % of a soluble calcium, aluminum or chromium salt (2) 5 to 20 wt. % of the chloride, nitrate, or sulphate salts of sodium, potassium, or lithium, (3) 0.1 to 1.0 wt. % of polyhexamethylene biguanide hydrochloride, or (4) 0.35 to 1.0 wt % of citric acid so as to produce a treated substrate,
(B) then applying to at least a portion of said treated substrate a second aqueous composition comprising a dye and 0.2 to 6.0 wt. % alginate.

2. A process of claim 1, in which the second aqueous composition further comprises thickening agents which are one or more of guar, locust bean gum, carboxymethyl cellulose, synthetic polymers, and starch ether.

3. A process of claim 1, in which the first aqueous composition comprises 0.025 to 0.275 wt. % anhydrous calcium chloride and in which the total amount of calcium chloride applied to the substrate is 0.03 to 0.5% based on the weight of the substrate.

4. A process as claimed in claim 1, in which the treated substrate of step (A) is dried prior to step (B).

5. A process as claimed in claim 1, in which the dye is a disperse dye, a reative dye, a combination of disperse and reactive dyes, or an acid dye.

6. A process for printing substrates which comprises:
(A) applying to at least a portion of a substrate a first aqueous composition comprising 5 to 20 wt. % of the chloride, nitrate, or sulphate salts of sodium, potassium, or lithium so as to produce a treated substrate,
(B) then applying to at least a portion of said treated substrate a second aqueous composition comprising a dye and 0.2 to 6.0 wt. % alginate.

7. A process of claim 6, in which the second aqueous composition further comprises thickening agents which are one or more of guar, locust bean gum, carboxymethyl cellulose, synthetic polymers, and starch ether.

8. A process for printing substrates which comprises:
(A) applying to at least a portion of a substrate a first aqueous composition comprising 0.1 to 1.0 wt. % of polyhexamehtylene biguanide hydrochloride so as to produce a treated substrate,
(B) then applying to at least a portion of said treated substrate a second aqueous composition comprising a dye and 0.2 to 6.0 wt. % alginate.

9. A process of claim 8, in which the second aqueous composition further comprises thickening agents which are one or more of guar, locust bean gum, carboxymethyl cellulose, synthetic polymers, and starch ether.

10. A process for printing substrates which comprises:
(A) applying to at least a portion of a substrate a first aqueous composition comprising 0.35 to 1.0 wt. % of citric acid so as to produce a treated substrate,
(B) then applying to at least a portion of said treated substrate a second aqueous composition comprising a dye and 0.2 to 6.0 wt. % alginate.

11. A process of claim 10, in which the second aqueous composition further comprises thickening agents which are one or more of guar, locust bean gum, carboxymethyl cellulose, synthetic polymers, and starch ether.

* * * * *